US011180314B2

(12) United States Patent
Smyth

(10) Patent No.: US 11,180,314 B2
(45) **Date of Patent: *Nov. 23, 2021**

(54) TOILET PAPER HOLDER AND TRASH RECEPTACLE

(71) Applicant: Christina Smyth, New York, NY (US)

(72) Inventor: Christina Smyth, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/742,610

(22) Filed: Jan. 14, 2020

(65) Prior Publication Data

US 2020/0223628 A1 Jul. 16, 2020

Related U.S. Application Data

(63) Continuation of application No. 15/726,717, filed on Oct. 6, 2017, now Pat. No. 10,549,909.

(60) Provisional application No. 62/419,034, filed on Nov. 8, 2016.

(51) Int. Cl.

| | |
|---|---|
| ***B65F 1/00*** | (2006.01) |
| ***A47K 10/22*** | (2006.01) |
| ***B65F 7/00*** | (2006.01) |
| *B65F 1/16* | (2006.01) |

(52) U.S. Cl.

CPC ..... *B65F 1/004* (2013.01); *A47K 10/22* (2013.01); *B65F 7/00* (2013.01); *B65F 1/163* (2013.01); *B65F 1/1638* (2013.01); *B65F 2001/1661* (2013.01); *B65F 2210/129* (2013.01); *B65F 2210/139* (2013.01); *B65F 2210/168* (2013.01); *B65F 2230/116* (2013.01); *B65F 2240/164* (2013.01)

(58) Field of Classification Search

CPC ..... A47K 10/22; B65D 43/16; B65D 43/26; B65D 25/04; B65D 25/00; B65D 51/04; B65F 1/00; B65F 1/004; B65F 1/12; B65F 1/16; B65F 1/163; B65F 1/1638; B65F 7/00; B65F 2001/1661; B65F 2210/129; B65F 2210/139; B65F 2210/168; B65F 2230/116; B65F 2240/164

See application file for complete search history.

(56) References Cited

U.S. PATENT DOCUMENTS

| | | | | |
|---|---|---|---|---|
| 4,902,482 A | | 2/1990 | Faust | |
| 5,035,563 A | * | 7/1991 | Mezey | B65F 1/004 220/909 |
| 6,019,242 A | * | 2/2000 | Wysocki | B65F 1/004 220/909 |

(Continued)

FOREIGN PATENT DOCUMENTS

| | | | | |
|---|---|---|---|---|
| CN | 201864250 U | | 6/2011 | |
| CN | 202967230 U | * | 6/2013 | B65F 1/00 |

(Continued)

*Primary Examiner* — Bryon P Gehman

(74) *Attorney, Agent, or Firm* — Weber Rosselli & Cannon LLP

(57) ABSTRACT

The present disclosure is directed to apparatus including a container having an open top end, a closed bottom end, and a sidewall. The apparatus also includes a divider disposed within the container forming a first chamber and a second chamber isolated from the first, and a lid movably secured relative to the open top end of the container such that upon moving from a first closed position to a second open position at least one of the first or second chamber is accessible.

15 Claims, 3 Drawing Sheets

(56) References Cited

U.S. PATENT DOCUMENTS

| | | | | |
|---|---|---|---|---|
| D446,619 | S | 8/2001 | Howard et al. | |
| 6,386,386 | B1 | 5/2002 | George | |
| D476,457 | S | 6/2003 | Verbeek | |
| D503,021 | S | 3/2005 | Yang et al. | |
| D530,874 | S | 10/2006 | Lin | |
| D579,618 | S | 10/2008 | Wang et al. | |
| 7,703,622 | B1 | 4/2010 | Bynoe | |
| D657,108 | S | 4/2012 | Yang et al. | |
| 8,328,019 | B2 | 12/2012 | Dermo | |
| 8,356,723 | B2 | 1/2013 | Clement et al. | |
| 8,418,869 | B2 | 4/2013 | Yang et al. | |
| 8,544,673 | B1 | 10/2013 | Polk | |
| D759,332 | S | 6/2016 | Basmajian et al. | |
| D762,037 | S | 7/2016 | Chen | |
| 9,434,538 | B2 | 9/2016 | Yang et al. | |
| 2006/0243731 | A1* | 11/2006 | O'Brien | B65F 1/16 220/507 |
| 2010/0237074 | A1 | 9/2010 | Yang et al. | |
| 2016/0137412 | A1 | 5/2016 | Capetillo et al. | |
| 2018/0110893 | A1* | 4/2018 | Chang | B65F 1/1638 |

FOREIGN PATENT DOCUMENTS

| | | | |
|---|---|---|---|
| CN | 203402559 | U | 1/2014 |
| CN | 103771059 | A | 5/2014 |
| CN | 204872368 | U | 12/2015 |
| CN | 205045304 | U | 2/2016 |
| CN | 205569247 | U | 9/2016 |
| KR | 101010853 | B1 | 1/2011 |

* cited by examiner

TOILET PAPER HOLDER AND TRASH RECEPTACLE

CROSS REFERENCE TO RELATED APPLICATIONS

The instant application claims priority to U.S. patent application Ser. No. 15/726,717, filed Oct. 6, 2017, now allowed, which claims the benefit of and priority to U.S. Provisional Application Ser. No. 62/419,034 entitled "Toilet Paper Holder and Trash Receptacle," filed Nov. 8, 2016, the entire contents of which is incorporated herein by reference.

TECHNICAL FIELD

The present disclosure relates to a waste basket with integrated storage and, more particularly, to a secure, sanitary receptacle for storing toilet paper and other lavatory products while also useable as a waste basket.

BACKGROUND

Every bathroom requires a trash receptacle. Simultaneously nearly every bathroom requires a secure, yet accessible location for storage of items such as extra rolls of toilet paper, sanitary napkins and other feminine products, etc. In many bathrooms, the discreet storage for such items is severely limited. Traditional spaces such as under-sink storage may not be available when the bathroom employs a pedestal sink. Further, in many smaller bathrooms, there may be no other storage such as medicine cabinets or small closets for storage of items. Moreover, as nearly universally understood, storage of items proximate the toilet is not only convenient but can be very important to a user.

There exist a variety of solutions for the storage of items in a bathroom, including decorative posts on which toilet tissue may be placed. Some of these even include a type of shielding to prevent undesired wetting or contact with unsanitary conditions prevalent in most bathrooms, particularly those which are employed by the elderly or children. However, these solutions are not ideal and further development is required to address the shortcomings of the known solutions.

SUMMARY OF THE INVENTION

The present disclosure is directed to an apparatus including a container having an open top end, a closed bottom end, and a sidewall. A divider is disposed within the container forming a first chamber and a second chamber isolated from the first. The apparatus also includes at least one lid movably secured relative to the open top end of the container such that upon moving from a first closed position to a second open position at least one of the first or second chamber is accessible.

The apparatus may include a foot pedal operably connected to the lid to move the lid from the first closed position to the second open position, and may also include a dampener to slow the return of the lid from the second open position to the first closed position.

In one aspect of the disclosure, the apparatus may have a two-part lid, wherein a first part of the two-part lid covers the first chamber and a second part of the two-part lid covers the second chamber. The first or second parts of the two-part lid may be operably connected to the foot pedal to move the first or second parts of the two-part lid from the second closed position to the first open position. Alternatively, the first and second parts of the two-part lid may both be operably connected to the foot pedal. The foot pedal may be configured to enable the first and second parts of the two-part lid move independently of one another or in unison with one another.

In a further aspect of the disclosure the divider is integrally formed with an inner container sized and shaped to be received within the container which defines the first and second chambers. The first or second chambers may be sized to receive a roll of toilet paper. Further, a pocket may be formed on an inner surface of one of the first or second chambers and sized to receive feminine hygiene products.

In a further aspect of the disclosure, at least one light operable to illuminate at least one of the first and second chambers is included. The light may emit ultraviolet light to sanitize at least one of the first or second chambers.

In still a further aspect of the present disclosure, a first part of the two-part lid covers the first chamber and a second part of the two-part lid covers the second chamber, and each of the first and second parts of the two part lid are hand operated to move the first or second part of the lid from the first closed position to the second open position. The first or second parts of the lid may include at least one dampener slowing the movement of the first or second part of the two-part lid as it moves from the second open position to the first closed position.

Further, to the extent consistent, any of the aspects described herein may be used in conjunction with any or all of the other aspects described herein.

BRIEF DESCRIPTION OF THE DRAWINGS

Objects and features of the presently disclosed system and method will become apparent to those of ordinary skill in the art when descriptions of various embodiments thereof are read with reference to the accompanying drawings, of which.

DETAILED DESCRIPTION

The present disclosure is directed to a waste basket with integrated storage and, more particularly, to a secure, sanitary receptacle for storing toilet paper and other lavatory products while also being useable as a waste basket.

As can be understood, it is often desirable that replacement rolls of toilet tissue be stored near the toilet, particularly when the in-place roll expires. Current methods of storing extra rolls of toilet paper can expose the rolls to air, sight, water, and contaminants, none of which is desirable. As is readily understood, these methods are less than optimal as they do not satisfy immediate access to clean fresh rolls of toilet papers, nor are they sanitary, since the rolls that have been stacked are exposed to a variety of contaminants. Thus, there is a need for a sanitary container for fresh rolls of toilet tissue and other items that are kept in close proximity to the toilet. Moreover, efficiencies can be achieved, as described herein, when the sanitary container is combined with a waste basket.

Figure 1:
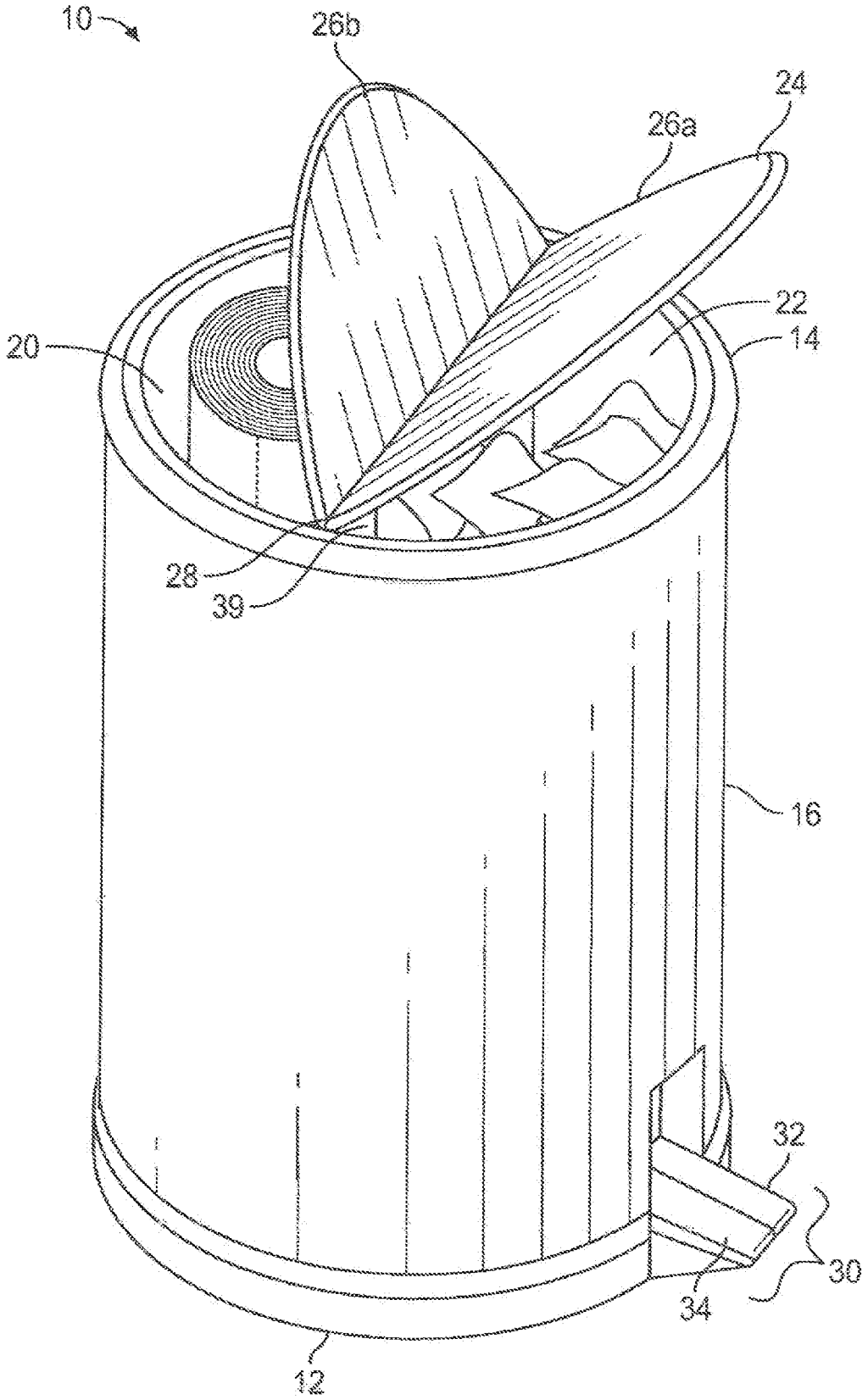
FIG. 1 is a perspective view of an apparatus of the present disclosure.
Figure 2:
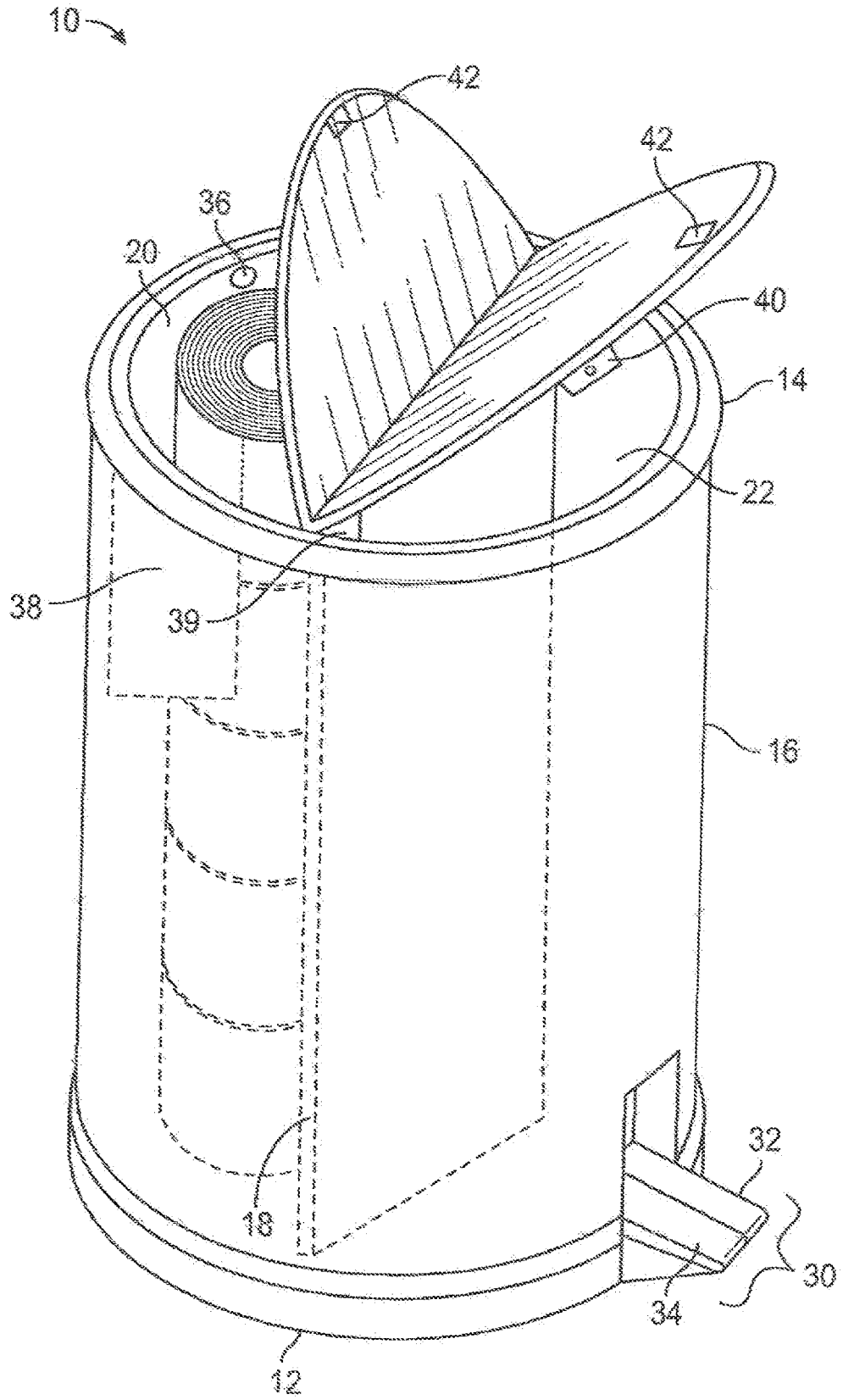
FIG. 2 is a see-through view depicting internal aspects of the apparatus of FIG. 1.

FIG. 1 depicts an example of waste basket 10 in accordance with the present disclosure. The waste basket 10 includes a bottom end 12, a top end 14, and a sidewall 16. The sidewall 16 extends from the top end 14 to the bottom end 12 to form a container. The bottom end 12 is closed to prevent items placed with in the waste basket 10 from falling through the bottom end 12. A divider 18 (FIG. 2) separates the interior volume of the waste basket 10 into a first and second chambers 20 and 22, respectively. The waste basket 10 includes at least one lid 24 movably secured relative to the top end of the container such that upon moving from a first closed position to a second open position at least one of the first or second chamber is accessible. As depicted in FIGS. 1 and 2, the lid 24 is composed of two parts 26*a* and 26*b*, each of which can be moved from an open position as shown in FIG. 1 to a closed position to cover the first and second chambers 20 and 22 in waste basket 10. As depicted, the two parts 26*a* and 26*b* are connected to each other via a hinge 28, and by this same hinge 28, are connected to the top end 14. Alternatively, each of parts 26*a* and 26*b* may be hinged and connected to the top end 14 at a location opposite the divider 18.

The two parts 26*a* and 26*b* of the lid 24 may upon closure rest on a lip (not shown) formed on an interior surface of the top end 14 such that the two parts 26*a* and 26*b* sit flush with a top surface of the top end 14. Alternatively, the two parts 26*a* and 26*b* may be formed with a lip (not shown) such that the two parts 26*a* and 26*b* extend over an cover the top end 14 of the waste basket 10, thereby affording greater protection and prevention of ingress of fluids and other contaminants.

The two parts 26*a* and 26*b* may be manually lifted from the top end 14 to expose the first or second chambers 20 and 22. Though not shown, a finger hold or other gripping means can be formed on a surface of the two parts 26*a* and 26*b* to provide a secure gripping location to operate the first and second parts 26*a* and 26*b* of the lid 24.

Alternatively, the lid 24 may be operated by a foot pedal 30. In one aspect a single foot pedal 30 operates both parts 26*a* and 26*b* of the lid 24. Alternatively, separate portions 32 and 34 of the foot pedal 30 may operate parts 26*a* and 26*b* of the lid 24, independently. Though not shown, the mechanism connecting the foot pedal 30 or portions 32 and 34 to the lid 24 and the parts 26*a* and 26*b*, including pus rods, bearings, connections, etc., are conventional and would be understood to those of ordinary skill in the art.

A light 36 may be included in either of the first or second chamber 20 and 22, or both. The light 36 can illuminate the chambers 20, 22 upon opening of the first or second parts 26*a*, 26*b* of the lid 24. For example, a switch may be associated with the foot pedal 30 to turn the light 36 on when depressed. Alternatively, the lid 24 and particularly parts 26*a* and 26*b* may be associated with a switch related to the top part 14 such that upon moving the lid 24 or parts 26*a* and 26*b* from a closed orientation to an open orientation (as shown in FIG. 2), the switch closes and the light 36 illuminates. The light 36 may be battery powered and may consist of a light emitting diode or an incandescent light bulb. Alternatively, the waste basket 10 may be connected to a mains outlet to power the light 36. Further, the light may emit light in the ultraviolet spectrum to provide a sanitizing aspect to the waste basket 10. Upon opening of the lid 24 or parts 26*a* or 26*b*, the light 36 can be initialized and remain on for some duration following closure to kill germs and bacteria which may find their way into one of the chambers 20, 22 as a result of the opening. This may be of particular utility for a chamber 20, as depicted in FIGS. 1 and 2, in which toilet tissue is stored, ensuring that upon retrieval of the tissue a user can have some confidence that the tissue is sanitary.

A further aspect of the present disclosure is directed to a pocket 38 formed on an inner surface of one of the chambers 20, 22. The pocket 38 is designed to store feminine hygiene products. As can be imagined the sanitary and secure storage of feminine hygiene products, much like toilet tissue, can be very useful to eliminate undesirable embarrassment of guests and visitors by eliminating the need to ask indelicate questions at inopportune times. The pocket 38 is preferably located at a distance from the top end 14 to provide sufficient closure for the lid 24, yet still remain above the bottom end 12 so that the pocket 38 and, more importantly, anything held therein can be readily seen by a user of the waste basket 10.

In accordance with a further aspect of the present disclosure, the divider 18 is integrally formed with a liner (not expressly shown) which substantially conforms to the interior of the waste basket 10 and is removable therefrom. In accordance with this embodiment the lid 24 and parts 26*a* and 26*b* can be removed from the waste basket 10 to allow for removal of the liner.

Another aspect of the present disclosure is directed to the use of dampeners 39 on the lid 24 and parts 26*a* and 26*b*. In accordance with this aspect, upon release of the parts 26*a* or 26*b*, either manually or by release of the foot pedals 32, 34, return of the parts 26*a* and 26*b* to their closed position atop the top end 14 is slowed by the use of dampeners 39. These dampeners 39 eliminate undesirable noise associated with the unrestrained closure of the lid 24 and parts 26*a* and 26*b*.

Yet a further feature of the present disclosure is an air freshener or perfumer 40 located in one or both of parts 26*a*, 26*b* of lid 24. The perfumer 40 may release the perfume or odor fighting substance upon opening to prevent or eliminate the release of odors from the waste basket 10. Though depicted on the interior surface of the lid 24, the perfumer 40 also be located on an interior surface of the sidewall 16.

Though lid 24 and parts 26*a* and 26 *b* are described herein as being either manually opened or opened by use of the foot pedal 30, there are other options. In accordance with a further aspect of present disclosure, the lid 24 and parts 26*a* and 26*b* can be opened via a motorized system (not shown). The motorized system may be associated with the dampeners 39 and may be initiated by passing a hand over or in proximity to a sensor 42 located on parts 26*a* and 26*b*. This sensor 42, which may be an optical sensor, can close a circuit and cause a motor to start driving the parts 26*a* or 26*b* from a closed position to an open position.

Figure 3:
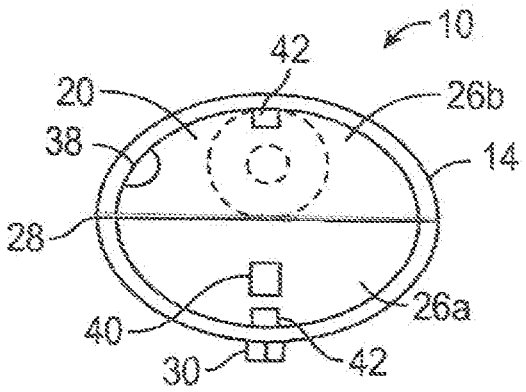
FIG. 3 is a top view of an apparatus of the present disclosure.

FIG. 3 depicts a top view of the wastebasket 10 in accordance with the present disclosure. As can be seen in this view, the majority of the chamber 20 is occupied by toilet tissue. Further, the pocket 38 takes up less space within the chamber 20 and remains accessible through part 26*b* of lid 24.

Figure 4:
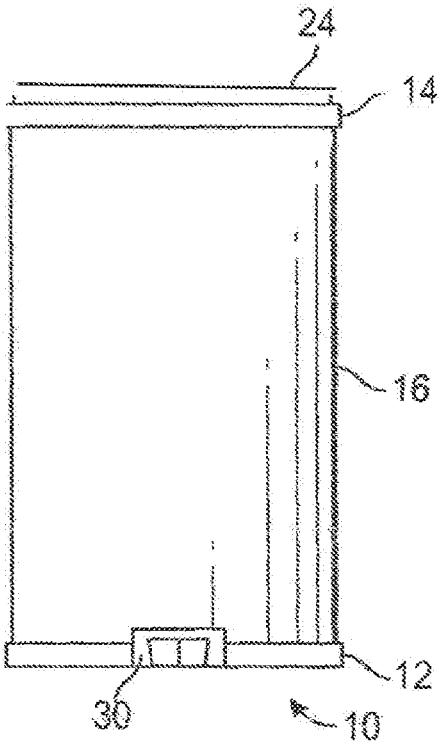
FIG. 4 is a front view of an apparatus of the present disclosure.
Figure 5:
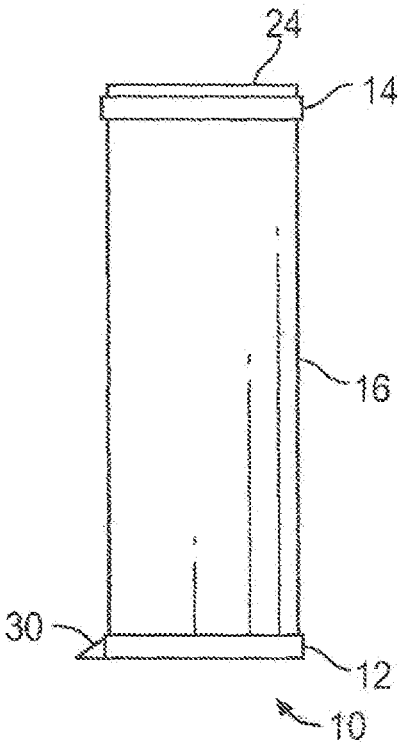
FIG. 5 is a side view of an apparatus of the present disclosure.

FIGS. 4 and 5 are front and side views of embodiments of the present disclosure, and clarify that a variety of shapes and sizes of waste basket 10 are possible without departing from the scope of the present disclosure. Other shapes for the waste basket 10 include square, rectangular, oblong, round, trapezoidal, frusto-conical, hexagonal, pentagonal, octagonal, and others.

As described herein, the present disclosure includes a combination toilet tissue roll holder and bathroom wastepaper basket. Extra rolls are hidden and remain substantially sanitary as they are separated from the environment in which the waste basket 10 is located. The waste basket 10 has dual purposes (storage and refuse receptacle) and thereby creates space savings because consumers do not need two different items to achieve these purposes.

Although embodiments have been described in detail with reference to the accompanying drawings for the purpose of illustration and description, it is to be understood that the inventive processes and apparatus are not to be construed as limited thereby. It will be apparent to those of ordinary skill in the art that various modifications to the foregoing embodiments may be made without departing from the scope of the disclosure as set forth in the following claims.

What is claimed is:

1. An apparatus comprising:

a container having an open top end, a closed bottom end, and a sidewall;

a divider disposed within the container forming a first chamber and a second chamber isolated from the first; and a two-part lid movably secured relative to the open top end of the container by a hinge mounted on the divider, wherein upon moving a first part of the two-part lid about the hinge and in the direction of a second part of the two-part lid from a first closed position to a second open position the first chamber is accessible and a foot pedal operably connected to the first part of the two-part lid to move the first part from the first closed position to the second open position.

2. The apparatus of claim 1, further comprising a dampener to slow a return of the first part from the second open position to the first closed position.

3. The apparatus of claim 1, wherein the first part covers the first chamber and the second part covers the second chamber.

4. The apparatus of claim 3, wherein the foot pedal is operably connected to the second part to move the second part from the first closed position to the second open position.

5. The apparatus of claim 4, wherein the foot pedal is configured to enable the first part and the second part to move independently of one another.

6. The apparatus of claim 4, wherein the foot pedal is configured to operate the first part and the second part in unison with one another.

7. The apparatus of claim 1, wherein the divider is integrally formed with an inner container sized and shaped to be received within the container which defines the first and second chambers.

8. The apparatus of claim 1, wherein the first chamber or second chamber is sized to receive a roll of toilet paper.

9. The apparatus of claim 1, further comprising a pocket formed on an inner surface of one of the first chamber or second chamber and sized to receive feminine hygiene products.

10. The apparatus of claim 1, further comprising a light operable to illuminate the first chamber or the second chamber.

11. The apparatus of claim 10, wherein the light emits ultraviolet light to sanitize at the first chamber or the second chamber.

12. The apparatus of claim 11, further comprising at least one dampener slowing movement of the first part or second part of the two-part lid as it moves from the second open position to the first closed position.

13. The apparatus of claim 1, wherein the second part is hand operated to move from the first closed position to the second open position.

14. A bathroom wastebasket comprising:

a container having an open top end, a closed bottom end, and a sidewall;

a divider disposed within the container forming a first chamber and a second chamber isolated from the first chamber, wherein the first chamber is sized to receive a roll of toilet paper;

a two-part lid movably secured relative to the open top end of the container by a hinge mounted proximate the divider, wherein upon moving a first part of the two-part lid about the hinge and in the direction of a second part of the two-part lid from a first closed position to a second open position the first chamber is accessible;

a foot pedal operably connected to the first part of the two-part lid to move the first part from the first closed position to the second open position; and a light arranged to illuminate the first chamber with an ultraviolet light to sanitize the first chamber.

15. The bathroom wastebasket of claim 14, further comprising a second light arranged to illuminate the second chamber with ultraviolet light to sanitize the second chamber.

* * * * *